United States Patent [19]

Johnson et al.

[11] Patent Number: 4,741,176

[45] Date of Patent: May 3, 1988

[54] BEVERAGE COOLER

[76] Inventors: Mark D. Johnson, Box 180 APO, New York, N.Y. 09030; George Spector, 233 Broadway, Rm 3815, New York, N.Y. 10007

[21] Appl. No.: 46,894

[22] Filed: May 7, 1987

[51] Int. Cl.[4] ..... F25D 3/08

[52] U.S. Cl. ..... 62/457; 62/530

[58] Field of Search ..... 62/457, 372, 530

[56] References Cited

U.S. PATENT DOCUMENTS

| | | | |
|---|---|---|---|
| 3,161,031 | 12/1964 | Flannery | 62/530 X |
| 4,183,226 | 1/1980 | Moore | 62/457 |
| 4,324,111 | 4/1982 | Edwards | 62/457 |
| 4,383,422 | 5/1983 | Gordon et al. | 62/457 |
| 4,393,975 | 7/1983 | Moore | 62/457 |

*Primary Examiner*—Lloyd L. King

[57] ABSTRACT

A beverage cooler is provided that includes a cylindrical freezer pack insert placed into a cup with cover to keep a beverage container colder longer. In a modification the cylindrical freezer pack insert includes removable sections to change its size and removable plugs so as to put coolant fluid therein.

1 Claim, 1 Drawing Sheet

BEVERAGE COOLER

BACKGROUND OF THE INVENTION

The instant invention relates generally to coolent devices and more specifically it relates to a beverage cooler.

Numerous coolent devices have been provided in prior art that are adapted to maintain the desired cool temperature of its contents. For example, U.S. Pat. Nos. 3,302,428; 4,163,374 and 4,299,100 all are illustrative of such prior art. While these units may be suitable for the particular purpose to which they address, they would not be as suitable for the purposes of the present invention as heretofore described.

SUMMARY OF THE INVENTION

A primary object of the present invention is to provide beverage cooler that will overcome the shortcomings of the prior art devices.

Another object is to provide a beverage cooler that includes a cylindrical freezer pack insert placed into a cup with cover to keep a beverage container colder longer.

An additional object is to provide a beverage cooler in which the cylindrical freezer pack insert includes removable sections to change its size and removable plugs so as to put coolent fluid therein.

A further object is to provide a beverage cooler that is simple and easy to use.

A still further object is to provide a beverage cooler that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
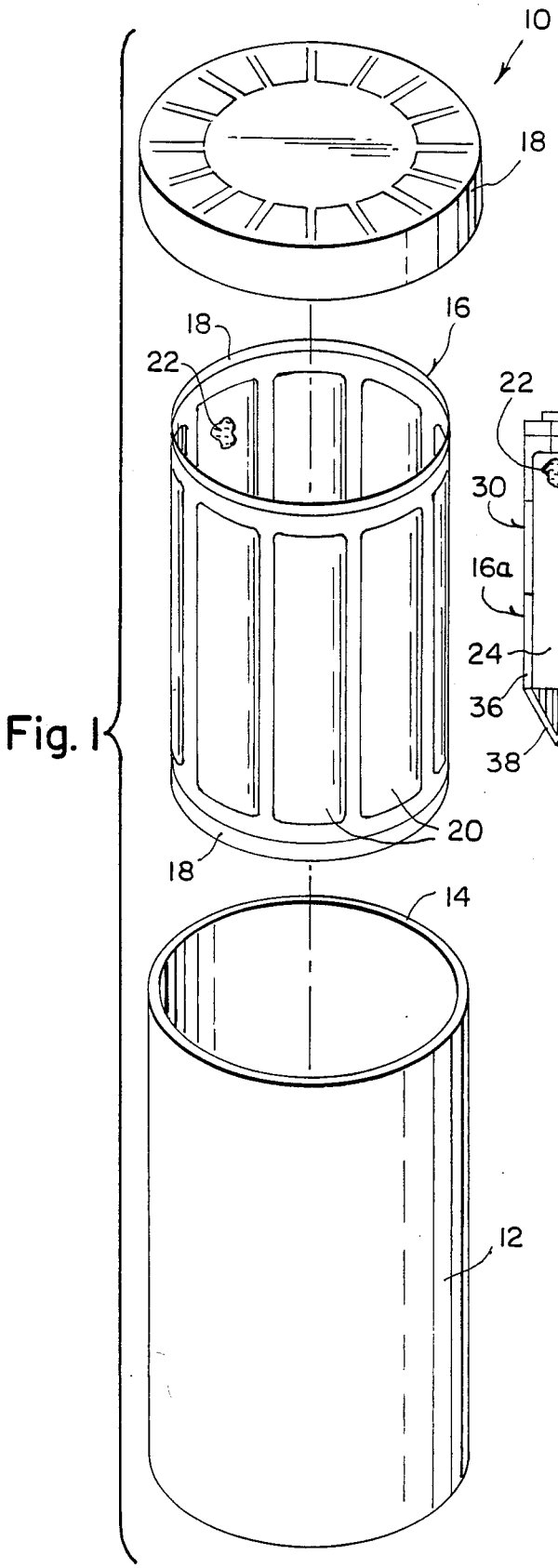
FIG. 1 is an exploded perspective view of the invention.

Turning now descriptively to the drawings, in which similar reference characters denote similar elements throughout the several views, FIG. 1 illustrates a beverage cooler 10 that consists of a cylindrical plastic or styrofoam cup 12 that has an open top 14. A hollow cylindrical freezer pack insert 16 is placed within the open top 14 of the cylindrical cup 12 so that a beverage container (not shown) can be placed therein. A reinforce plastic or styrofoam cover 18 is placed over the open top 14 of the cylindrical cup 12 so that the hollow cylindrical freezer pack insert 16 will keep the beverage container colder longer.

The hollow cylindrical freezer pack insert 16 includes rigid top and bottom plastic edges 18 to help the freezer pack insert keep its hollow cylindrical shape. A plurality of vertical spaced apart plastic flexible pouches 20 are around perimeter to hold coolant fluid 22 inside to be frozen.

Figure 2:
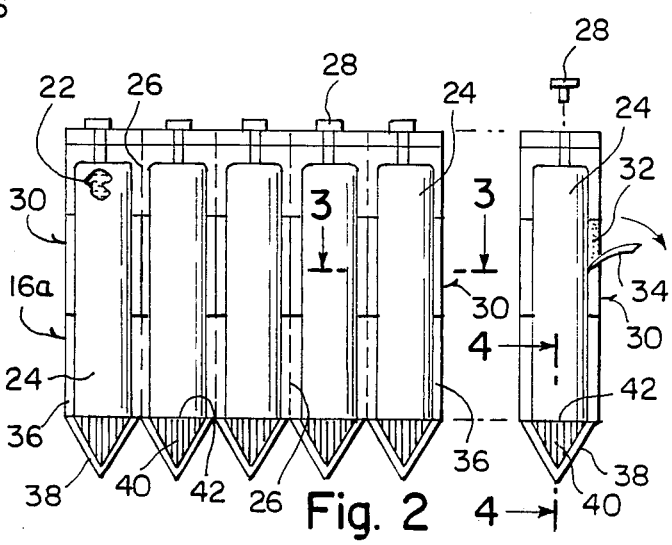
FIG. 2 is a front view with parts broken away of a modification of the freezer pack insert having removable sections to change size thereof and removable plugs so as to put coolant fluid therein.
Figure 3:
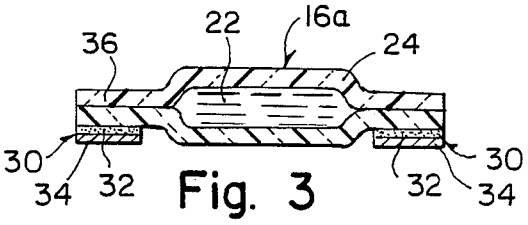
FIG. 3 is an enlarged cross sectional view taken along line 3—3 in FIG. 2.
Figure 4:
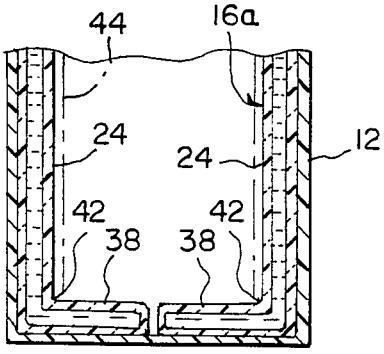
FIG. 4 is a cross sectional view taken along line 4—4 in FIG. 3 showing the freezer pack insert within the cup and beverage container therein in phantom lines.

FIG. 2 to 4 show a modified hollow cylindrical freezer pack insert **16*a* which includes a plurality of removable plastic pouch sections 24 that have perforations 26 therebetween. A removable plug 28 is provided for each of the pouch sections 24 so that coolant fluid 22 can be placed therein. Various types of fasteners 30 can also be provided such as tape 32 with pull off paper 34 as illustrated, a snap type device or other securement members (not shown). The fasteners 30 are for securing free ends 36 of the two remote pouch sections 24 together to form the hollow cylindrical shape of the freezer pack insert 16*a***.

Each of the removable pouch sections 24 includes a bottom wedge portion 38 with pleats 40 to also hold coolant fluid 22 therein and a fold line 42 is therebetween. When the hollow cylindrical freezer pack insert **16*a* is placed within the cylindrical cup 12 the bottom wedge portion 38 of each of the removable pouch sections 24 will bend inwardly along the fold line 42 allowing the beverage container 44, shown in phantom, to sit upon the bottom wedge portion 38 to help keep the beverage container 44** even colder longer.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A beverage cooler comprising:

(a) a cylindrical plastic/styrofoam cup having an open top;

(b) a hollow cylindrical freezer pack insert placed within said open top of said cylindrical cup so that a beverage container can be placed therein;

(c) a reinforced plastic/styrofoam cover placed over said open top of said cylindrical cup so that said hollow cylindrical freezer pack insert will keep the beverage container colder longer wherein said hollow cylindrical freezer pack insert includes:

(d) a plurality of removable plastic pouch sections having perforations therebetween;

(e) a removeable plug for each of said pouch sections so that coolant fluid can be placed therein; and (f) means for securing free ends of said two remote pouch sections together to form said hollow cylindrical shape of said freezer pack insert, wherein each of said removeable pouch sections includes a bottom wedge portion with pleats to also hold coolant fluid therein and a fold line therebetween so that when said hollow cylindrical freezer pack insert is placed within said cylindrical cup said bottom wedge portion of each of said removeable pouch sections will bend inwardly along said fold line allowing the beverage container to sit upon said bottom wedge portion to help keep the beverage container even colder longer.

* * * * *